United States Patent [19]

Nebel et al.

[11] 4,101,374

[45] Jul. 18, 1978

[54] DEWATERING DEVICE INCLUDING A DRUM WITH RADIALLY SLANTED CELLS

[76] Inventors: Dietrich Nebel, Engelsweidchen 11, Stockheim-Kreuzau; Hans Reicherter, Oberhaldenweg 35, 7417 Pfullingen, both of Fed. Rep. of Germany

[21] Appl. No.: 729,970

[22] Filed: Oct. 6, 1976

[30] Foreign Application Priority Data

Oct. 7, 1975 [DE] Fed. Rep. of Germany ..... 2544750

[51] Int. Cl.[2] ..... D21F 1/04

[52] U.S. Cl. ..... 162/306; 29/121.3; 162/317; 162/357; 162/371; 162/372

[58] Field of Search ..... 162/317, 357, 214, 306, 162/371, 372; 210/402; 29/121.3

[56] References Cited

U.S. PATENT DOCUMENTS

| | | | |
|---|---|---|---|
| 2,725,145 | 11/1955 | Mylius | 210/402 |
| 2,732,080 | 1/1956 | Strindlund | 162/357 X |
| 2,991,218 | 7/1961 | Cirrito et al. | 162/372 X |
| 3,018,825 | 1/1962 | Han et al. | 162/357 X |

*Primary Examiner*—Richard V. Fisher

[57] ABSTRACT

A roller to de-water fiber suspensions comprises a perforated drum having open ended radial cells formed in the wall thereof. The cells are defined by blades or bridges which form an angle with the radius of the drum at least at the forward end of the bridges by being slanted forward from the radius in the direction of rotation.

19 Claims, 3 Drawing Figures

8
7
4
1
3
Second Quadrant
First Quadrant
4
Third Quadrant
Fourth Quadrant
9
2'
2
6
5
5

DEWATERING DEVICE INCLUDING A DRUM WITH RADIALLY SLANTED CELLS

BACKGROUND OF THE INVENTION

The invention concerns a device to de-water fiber suspensions as used for instance in the fabrication of cardboard. The device consists of a perforated drum, the wall of which contains a multitude of openended radial cells, a drive which turns this drum in a given direction, a material feeder, an installation to facilitate the tangential removal of the product, namely a fibersheet, and a trough to catch and remove the suspended water originating from the fiber suspension in the above mentioned perforated drum.

Commonly the de-watering of fiber suspension in the filter drums is achieved by using negative pressure, e.g. vacuum, to direct the water towards the center of the drum and to drain it from there toward the outside. The vacuum system needed for this process is costly in installation and use, and uneveness or flaws in the fibersheet cannot be prevented. The "Scott Former" built by the American firm Black-Clawson uses a different principal. They use a perforated vacuum roller with a bronze sieve. The lower edge of the fibersheet-runoff runs along the filter drum's vertex while the upper edge protrudes and thereby forms the fibersheet under pressure. The extracted water is directed towards the filter drum's center by vacuum and then expelled by centrifugal force behind the fibersheet forming zone. A device in accordance with this principle of using a vacuum roller, is the recently better known "Honeycomb Roller" described in U.S. Pat. Nos. 3,100,928 and 3,590,453. The Honeycomb Roller is by merit of its cell structure superior to the more conventional vacuum rollers. The Honeycomb uses a maximum effective area, is relatively light in weight, thereby simplifying installation and, resulting in less stress on the bearings, and it shows high stability and little divergence from true alignment. These features make a high strain factor possible. The large size cells reduce the danger of plugging up since the inside is open. The installation of vacuum chambers and other options is relatively simple; furthermore, by using the Honeycomb a nontouching and therefore wearproof dynamic vacuum chamber seal installation is possible. By moving the endseals during the operation, the format of the product can even be changed.

Yet, at high production operation at high speed, it became evident that the centrifugal water extraction immediately behind the forming zone caused damage to the freshly formed fibersheet at or near the expulsion area and proved to be less satisfying.

The purpose of the invention is to provide a dewatering system as defined above; namely a system where the extracted water will be removed from the roller, but instead of by centrifugal force immediately behind the forming zone in a radial direction, it will be removed at a safe distance from the forming zone in a tangential direction and away from the fibersheet. The formation of an even, fine and vertical film of water is being striven for by the invention.

Furthermore, it is necessary to prevent the disorientation of the individual fibers during the forming process by outside influences or by the structural character of the roller surface. To achieve this, the negative pressure or vacuum on the inside of the perforated drum underneath the forming zone should be kept at a minimum, and a honeycomb structure of the cells should be avoided.

SUMMARY OF THE INVENTION

The invention solves this problem by directing the fiber suspension flow toward a zone which is near the beginning of and axial to the first roller quadrant, by removing the fibersheet in a tangential direction (relative to the direction of rotation) near the beginning of the second upper roller quadrant, and by having certain planes in the roller surface which are disposed axially to the surface and form an angle with the radial, and are slanted forward.

Generally, the present invention provides a device to de-water fiber suspensions to form a de-watered fibersheet comprising a perforated drum having a drum wall for supporting a mesh sieve and containing a plurality of radially disposed open ended cells, the cells being formed in part by bridges which extend axially relative to the drum wall and are radially slanted forward relative to the direction of rotation of the drum, at least at their outer ends, to define an acute angle of at least 10° with a radial plane passed through the respective bridge. Drive means to rotate the drum in a given direction of rotation about a horizontal axis of rotation are included, as is a material feeder to feed fiber suspension onto the drum. The material feeder terminates at a point which lies adjacent the drum wall and approximately at the beginning of a first quadrant of the drum to feed the fiber suspension at that point of termination on the drum. The cross-section of the drum being considered to have a first quadrant defined by the portion of the drum rising in the direction of rotation from the horizontal plane in which the axis of rotation of the drum lies, and second, third and fourth quadrants consecutively numbered in the direction of rotation. Finally, take off means are disposed adjacent the drum wall at the beginning of said second quadrant to remove the de-watered fibersheet tangentially from the drum wall.

In certain aspects of the invention, the cells are defined by axially extending walls and radially extending walls which are interconnected with each other, the bridges comprising the axially extending walls. Preferably, the axially extending walls are disposed perpendicularly to the direction of rotation and the radially extending walls are disposed parallel to the direction of rotation. The quadrants are identified relative to the direction of rotation. The fiber suspension starts to adhere to the roller surface at a point which is approximately in the horizontal plane. Starting at this point, the rising quadrant is identified as the first quadrant. This first quadrant ends at the vertix of the roller. The second quadrant begins at the vertex and falls toward the horizontal plane; and is followed by the third and fourth quadrants below the horizontal plane. Observed in a cross sectional view, and turning the roller sieve in a mathematically positive, that is, counterclockwise direction, the quadrant's identification relative to the geometrical x-y axis, is the usual and standard identification. As mentioned before, the fibers' adherance to the roller surface should begin near a zone which is, relative to the direction of rotation, at the beginning of the first roller quadrant. The axial length of the zone depends on the respective fibersheet composition. The thickness is governed by the distance between the lower and upper lips of the run-off and depends on various factors; for instance, concentration and feeding speed of the fiber suspension. The exact position of this zone is not critical, but according to the intent of this invention, it should be utilized to the maximum, that is, should be placed as near as possible to the horizontal plane. Furthermore, the intent of the invention is to have the tangential fibersheet take-off at the beginning of the second or falling quadrant. The exact angle position is also not critical and can be e.g., about 110 (angular) degrees relative to the horizontal plane.

Due to the positioning, as called for in accordance with the invention, of the fibersheet take-off line at its preferred angle of 90° or more to the run-off zone, the intended tangential water expulsion is achieved. The slanting of the water carrying cells helps this achievement and the dewatering of the fiber sheets is at a maximum by utilizing the full roller quadrant.

The unique roller sieve of the present invention prevents undesirable flows and eddys within the cells during operation by having the cell walls running parallel to the cylinder axis.

The radial slant of the axial cell surfaces delays the escape by centrifugal force of any water which is extracted from the fiber suspension and which is stored inside of these cells. It is understood that the angle of slant depends on the rotating speed of the rollersieve. At low speeds or with small roller diameters, an angle of 10 degress would be sufficient. Higher speed and or larger diameter could call for 40 or more angular degrees. This detail would be up to the individual expert who would, for instance, also consider the extracted water temperature, salinity, acidity, viscosity, surface tension, etc.

The de-watering device of the present invention leads to an almost isotoppic, homogeneous fibersheet. No radial expelled water can damage the newly formed fibersheet since the extracted water runs off in a tangential, approximately vertical direction. The water is being expelled at the end of the second—beginning of the third quadrant. This expulsion takes place as an uninterrupted sheet of water, in contrast to the common non-orthogonal arrangements where contraction into individual streams of water takes place.

In contrast to the well-known "Honeycomb Rollers," the present invention calls for an orthogonal cell arrangement, that is, the cell walls run parallel to the rotation direction. This arrangement results in maximum use of space being utilized for water expulsion, and undesirable flow and eddy forming is prevented, thereby avoiding marring of the newly formed fibersheet.

To achieve the greatest possible utilization of the cells in an axial direction, it is advisable that the cell design have forward slanting bridges connected in the direction of rotation by rings. These bridges could also be blended into the axial walls of the individual cells.

The preferred embodiment of the invention calls for interconnected, welded pipe segments having square or rectangular cross-sections to form the cells.

The bridges or radial running cell walls will, with increasing cylinder or roller diameter, show radial divergence. The bridges have to be placed accordingly. Whenever pipe segments are used to form the cylinder wall, the radial running pipe walls can be widened in a wedge-shaped manner in the direction of rotation. Another possibility would be to have the pipe walls disposed parallel and to take care of the radial divergence during the welding process.

During practical application of this invention, it became evident that in relation to the concentration of the fiber suspension the amount of water in the individual cells would only build up to a medium density. This density will of course depend on various factors as for instance the concentration of the fiber suspension, the rotating speed etc. Generally the density amounts to a few millimeters. To achieve the desired effect, it is sufficient to have the axial bridges or the axial running pipe walls curved or angled forward at the cylinder wall and to have the remaining part extend approximately radially.

With increasing rotation speed of the filter drum or roller, the danger of having the fibersheet damaged increases. That is, as the fibersheet begins to form at the beginning of the first roller quadrant, the water content becomes less and the centrifugal force tends to lift the new-formed fibersheet off the cylinder wall, thereby increasing the possibility of damage to the sheet. To prevent this, and to keep the fibersheet on the cylinder wall, one aspect of the invention calls for the installation of a negative pressure chamber. This chamber is installed at the inside of the filter drum or roller, is permanent and not flexible, extends for the full width of the fiber sheet, begins at the start of the forming zone, ends at the point of the fibersheet take-off and exerts minimal negative pressure. This negative pressure has to be only minimal and sufficient to keep the fibersheet on the drum. The extracted water inside the cells does not have to be vacuumed into the drum center. It is sufficient to keep the negative pressure in this chamber at about 2cm. to 15 cm., preferably at 8 cm. to 10 cm. of barometric pressure.

The axial running edges of the pressure chamber can be dynamically sealed at the inside of the cylinder by utilizing axial strips. In most cases it is sufficient to have only a space of a few millimeters between the strips and the inside cylinder wall. In the direction of rotation these strips would extend from a minimum of two to a maximum of five bridges. Preferably they should extend over three bridges. In accordance with one aspect of the invention, manufacture of the mantle of the drum or roller is achieved by using simple building elements. The cell structure consists of a multitude of four-sided pipe segments, their edges to be welded to the neighboring cells. This construction has the advantage that the individual cells can be manufactured by using standard, easily available four-sided pipe, and by using a drum pattern for easy assembly and welding. The pipe can have right angular, i.e., rectangular, or square cross sections.

The cell structure could also be manufactured by using flat rings which are bent to a zig-zag shape alternating from axial to rotating direction, and their edges being welded together. These zig-zag shaped flat rings could also be alternated with straight flat rings and thereby a cell structure could be formed.

The invention is not limited to the above mentioned construction methods. It can be used, generally speaking, with all kinds of drum construction methods in which the above defined cells are being utilized.

BRIEF DESCRIPTION OF THE DRAWINGS

The attached drawings show preferred embodiments of the invention.

Referring to FIG. 1:

DESCRIPTION OF THE PREFERRED EMBODIMENTS

Figure 1:
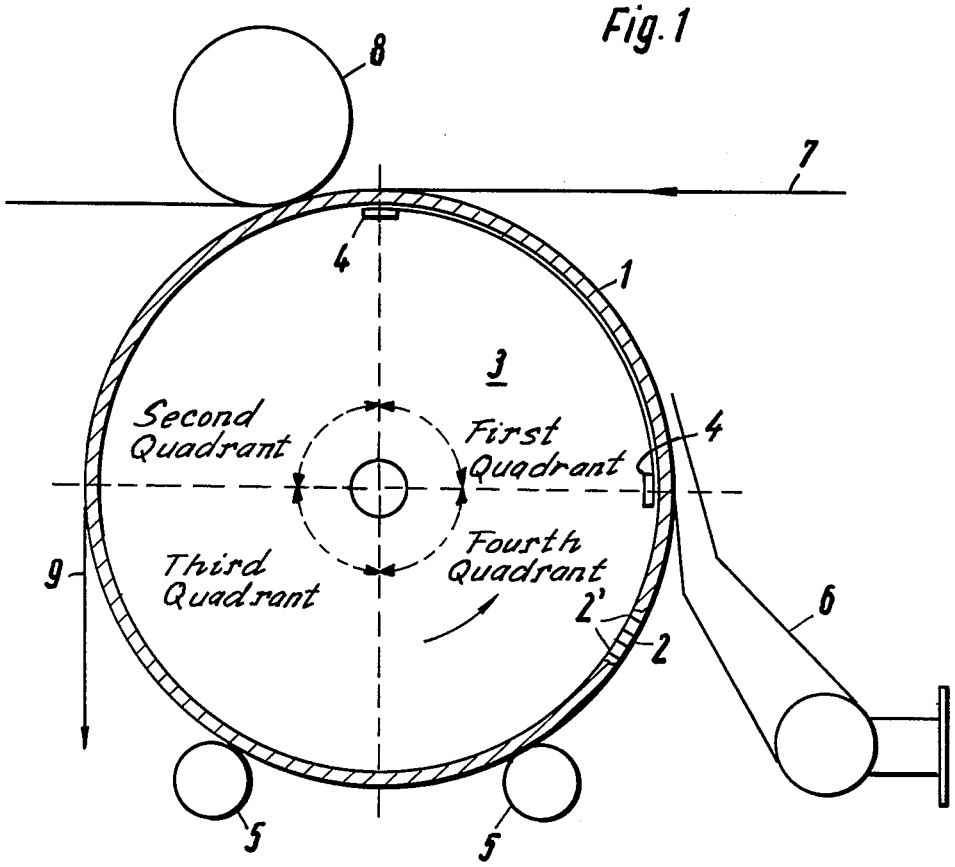
FIG. 1 shows one embodiment of the device of the invention.

The drum mantle or wall #1 consists of rows of cells #2 formed of a multitude of four-sided pipe segments #2', their edges being welded. The generally axially directed cell walls form relative to the direction of rotation of the drum or roller, an acute angle with a plane passing through the axis of the drum. That is, the generally axially directed cell walls are not quite radial, i.e., do not quite coincide with radii of the drum. The drum radii lie within and define "radial planes" of the drum. Inside the drum mantle or wall #1 is a slightly negative pressure chamber #3. This chamber #3 should preferably occupy one drum quadrant. The drum quadrants are indicated on FIG. 1 by imaginary dotted lines and arrows drawn in a cross pattern with the quadrants identified first, second etc., in accordance with conventional mathematical usage. The chamber walls are fitted with sealing strips #4 which in turn sweep the drum wall #1. The drum wall is supported at #5 by roll supports. A material feeder #6 feeds fiber suspension from an outside source onto the drum wall #1, specifically onto the drum at about the point where the horizontal plane in which the axis of rotation of the drum lies passes through wall #1, i.e., at the rising first quadrant in the direction indicated by the arrow. The chamber #3 is situated beneath this drum quadrant. Only the felt strip #7 and a take-off drum #8 are shown as part of the usual accessory equipment, also used with other types of filter drums. A trough, not shown in FIG. 1, is located underneath the drum wall or mantle #1.

The fiber suspension emerging from the material feeder #6 is de-watered by the drum wall #1 as follows: The water enters the drum wall #1, and is carried upwardly by rotation of the drum. Under the influence of gravity and centrifugal force, water is expelled downwards at #9 in the form of an even sheet of water.

No or only negligible fiber orientation takes place during the forming process, and the finished product shows a high stability throughout and not only in the direction of rotation.

Figure 2:
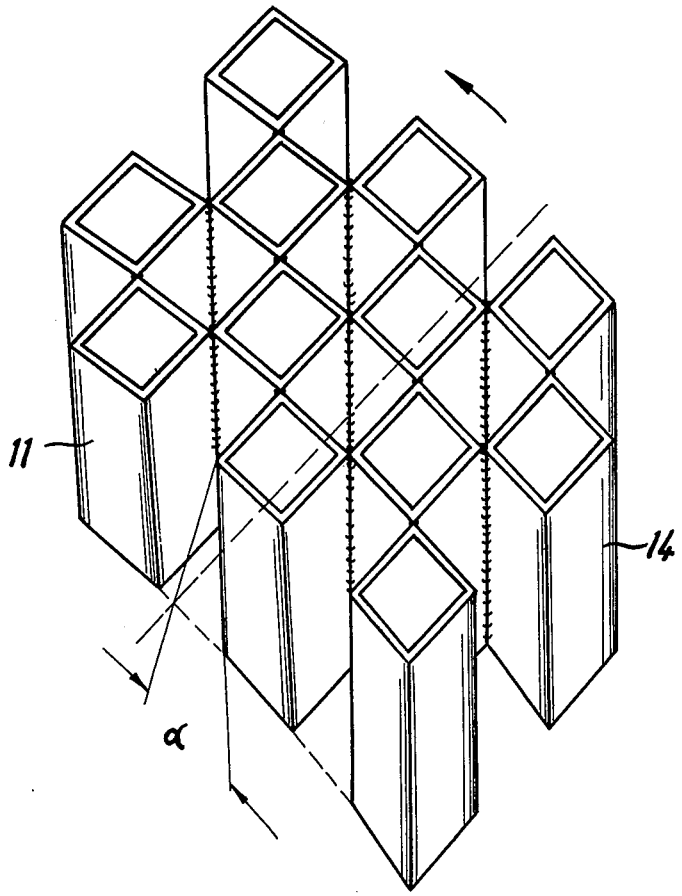
FIGS. 2, 3 and 4 show perspective views of preferred embodiments of the roller or drum mantle construction.

FIG. 2 shows part of a cell structure of the cylinder wall, consisting of four-sided pipe segments, #11, being welded to each other. These segments for instance, have the following dimensions: 10 by 10 by 30mm with a wall thickness of 1mm. The axial bridge is indicated by #14.

Figure 3:
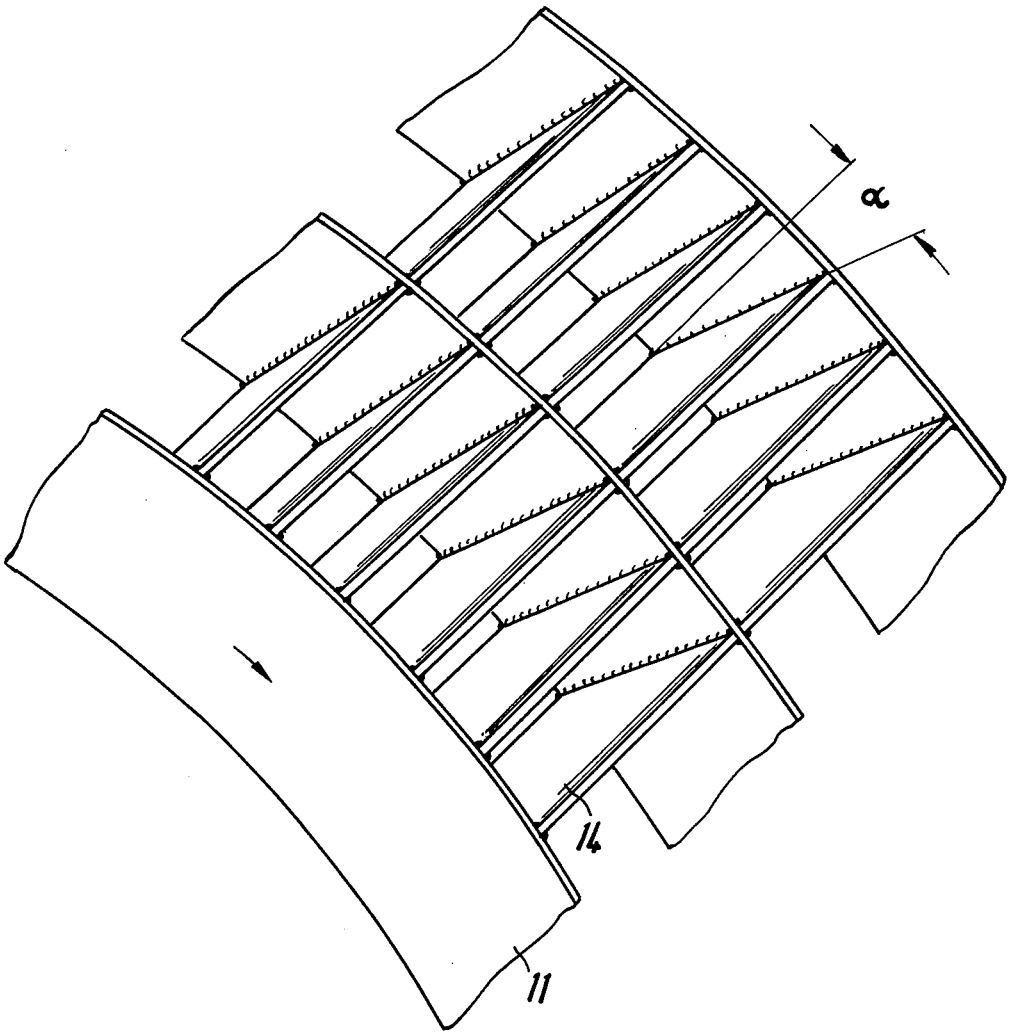
Figure 4:
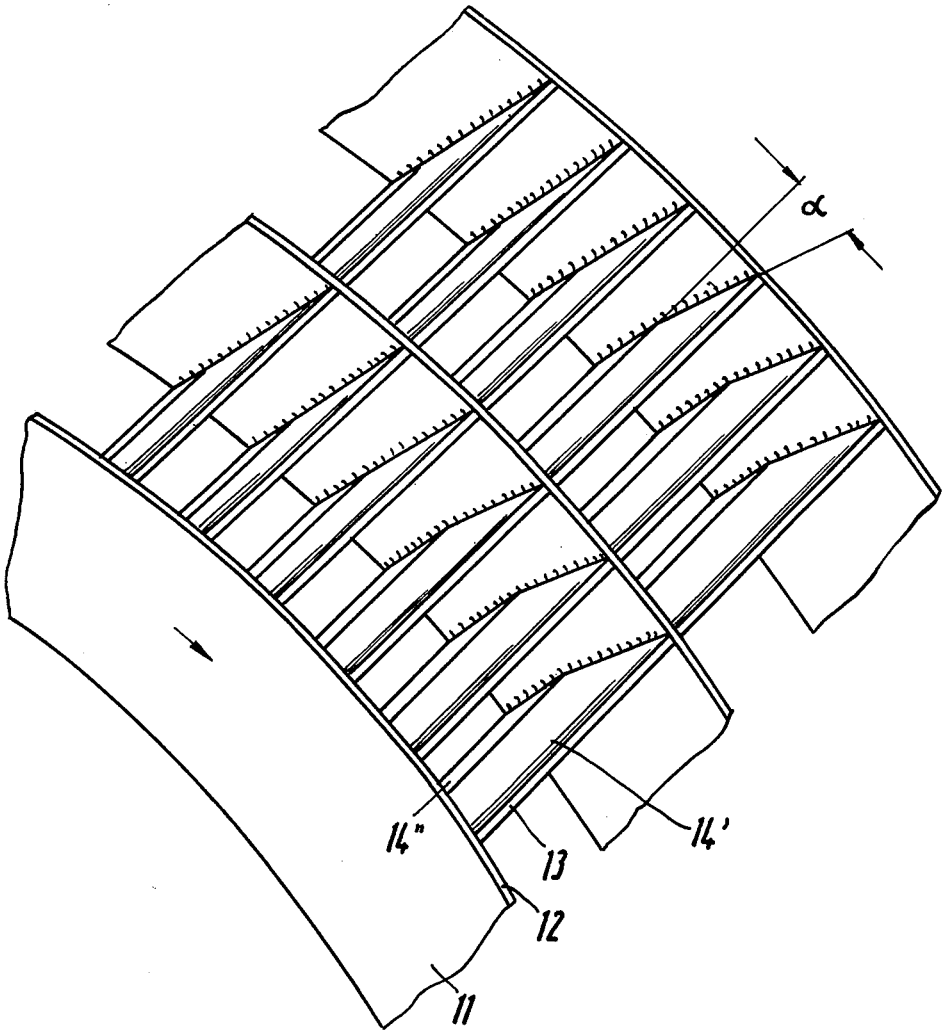

FIGS. 3 and 4 show a variation of the invention. Shown on these sketches are cylinder walls consisting of radial rings #11 and axial bridges #14. The bridges are slanted forward relative to the rotation direction by the angle $\alpha$. The fine mesh sieve which closes off the cells on the outside, and on which the fiber suspension settles, is not shown in FIGS. 1, 2,3 or 4. This sieve (not shown) rests on ring edges #12 of the rings #11, respectively on the edges #13 of the bridges #14, namely the edges which form the outside cylinder wall. The bridges #14 can be either flat but slanted forward by the angle $\alpha$ as shown in FIG. 3, or they can run radial with part #14" and fulfill the forward slant requirement with their part #14'. That is, an outside portion thereof, #14', may be slanted forward at the angle $\alpha$.

We claim:

1. A device to de-water fiber suspensions to form a de-watered fiber sheet comprising:

(a) a perforated drum (b) drive means to rotate said drum in a given direction of rotation about a horizontal axis of rotation;

(c) said drum having a drum wall for supporting a mesh sieve and containing a plurality of radially disposed open ended cells, said cells being formed in part by bridges which extend axially relative to said drum wall and are radially slanted forward relative to the direction of rotation of said drum at least at their outer ends to define an acute angle of at least 10 degrees with a radial plane passed through the respective bridge;

(d) a material feeder to feed fiber suspension onto said drum, said material feeder terminating at a point which lies adjacent said drum wall and approximately at the beginning of a first quadrant of said drum to feed said fiber suspension thereat, and the cross-section of said drum being considered to have a first quadrant defined by the portion of said drum rising in the direction of rotation from the horizontal plane in which the axis of rotation of said drum lies, and second, third and fourth quadrants consecutively numbered in the direction of rotation; and (e) take off means disposed adjacent said drum wall at the beginning of said second quadrant to remove de-watered fibersheet tangentially from said drum wall.

2. The device of claim 1 wherein said cells are formed by interconnected pipe sections having rectangular cross sections, said pipe sections providing said bridges.

3. The device of claim 1 in which said cells are defined by axially extending walls and radially extending walls interconnected with each other, and said bridges comprise said axially extending walls.

4. The device of claim 3 in which said axially extending walls are disposed perpendicularly to the direction of rotation and said radially extending walls are disposed parallel to the direction of rotation.

5. The device of claim 4 in which said radially extending walls are comprised of rings.

6. The device of claim 4 in which said cells are comprised of interconnected pipe segments of rectangular cross-section.

7. The device of claim 6 in which said pipe segments are wedge-shaped in the direction of rotation whereby said cells are wider at their outer ends than at their inner ends.

8. The device of claim 6 wherein said pipe segments are of uniform cross-section and the resultant radial divergence necessary to dispose said bridges in said radially slanted position is accommodated by welded segments disposed between adjacent pipe segments.

9. The device of claim 1 wherein said bridges are radially slanted forward at their outer ends and their inner ends are disposed in respective radial planes.

10. The device of claim 1 wherein the entirety of said bridges are radially slanted forward.

11. The device of claim 1 wherein a stationary negative pressure chamber is contained within said drum and axially extends longitudinally at least for the fibersheet forming width of said drum and extends radially from said point at which said material feeder terminates to at least the end of said first quadrant but not beyond the point at which said take off means is disposed adjacent said drum.

12. The device of claim 11 in which said negative pressure chamber is dynamically sealed by axially extending running strips spaced from the inside of said cylinder wall.

13. The device of claim 12 wherein said strips extend radially over at least two but not more than five of said bridges.

14. The device of claim 13 in which said strips extend radially over three of said bridges.

15. The device of claim 1 wherein said acute angle is an angle of between 10 to 40 degrees.

16. A device to de-water fiber suspensions to form a de-watered fibersheet comprising:

(a) a perforated drum;

(b) drive means to rotate said drum in a given direction about a horizontal axis of rotation;

(c) said drum having a drum wall for supporting a mesh sieve and containing a plurality of radially disposed open ended cells, said cells being formed by interconnected pipe sections having square cross sections, said pipe sections providing bridges which extend axially relative to said drum wall and are radially slanted forward relative to the direction of rotation of said drum at least at their outer ends to define an acute angle with a radial plane passed through the respective bridge whereby to delay the escape by centrifugal force of water from the cells;

(d) a material feeder to feed fiber suspension onto said drum, said material feeder terminating at a point which lies adjacent said drum wall and approximately at the beginning of a first quadrant of said drum to feed said fiber suspension thereat and the cross-section of said drum being considered to have a first quadrant defined by the portion of said drum rising in the direction of rotation of said drum lies, and second, third and fourth quadrants consecutively numbered in the direction of rotation; and (e) take off means disposed adjacent said drum wall at the beginning of said second quadrant to remove de-watered fibersheet tangentially from said drum wall.

17. The device of claim 16 in which said pipe segments are wedge-shaped in the direction of rotation whereby said cells are wider at their outer ends than at their inner ends.

18. The device of claim 16 wherein said pipe segments are of uniform cross-section and the resultant radial divergence necessary to dispose said bridges in said radially slanted position is accommodated by welded segments disposed between adjacent pipe segments.

19. The device of claim 16 wherein said bridges are radially slanted forward at their outer ends and their inner ends are disposed in respective radial planes.

* * * * *